US006805510B2

(12) United States Patent
Lee

(10) Patent No.: US 6,805,510 B2
(45) Date of Patent: Oct. 19, 2004

(54) COSMETIC POWDER APPLICATOR AND METHOD FOR MAKING AND USING THE SAME

(75) Inventor: Young-Gu Lee, 1496-21 Gwanyang 2-Dong, Dongan-Gu, Anyang-Si, Gyeonggi-Do (KR), 431-062

(73) Assignee: Young-Gu Lee, Gyeonggi-Do (KR)

( * ) Notice: Subject to any disclaimer, the term of this patent is extended or adjusted under 35 U.S.C. 154(b) by 0 days.

(21) Appl. No.: 10/300,673

(22) Filed: Nov. 19, 2002

(65) Prior Publication Data

US 2003/0161675 A1 Aug. 28, 2003

(30) Foreign Application Priority Data

Feb. 25, 2002 (KR) ..... 2002-0010011

(51) Int. Cl.[7] ..... A45D 33/02; B05C 19/04; B05C 19/06

(52) U.S. Cl. ..... 401/200; 401/196; 401/202; 401/206; 401/266

(58) Field of Search ..... 401/200, 202, 401/266, 5, 126, 130, 196, 206, 207, 264; 222/541.1

(56) References Cited

U.S. PATENT DOCUMENTS

| | | | |
|---|---|---|---|
| 4,269,527 | A | 5/1981 | Lipfert et al. |
| 4,451,164 | A | 5/1984 | Roberts, Jr. |
| 4,569,612 | A | 2/1986 | Schwartzman et al. |
| 4,747,720 | A | 5/1988 | Bellehumeur et al. |
| 4,772,148 | A | 9/1988 | Buschemeyer |
| 4,998,838 | A | 3/1991 | Cancelosa et al. |
| 5,167,462 | A | 12/1992 | Lucas |
| 5,230,579 | A | 7/1993 | Klawson et al. |
| 6,096,382 | A | 8/2000 | Gueret |

(List continued on next page.)

FOREIGN PATENT DOCUMENTS

| | | | |
|---|---|---|---|
| EP | 1 086 904 | A | 3/2001 |
| GB | 141 268 | A | 4/1920 |
| GB | 521943 | A | 6/1940 |
| JP | 6-15644 | | 3/1994 |
| JP | 11-028413 | | 2/1999 |
| KR | 88-200 | | 2/1988 |
| KR | 92-16358 | | 9/1992 |

(List continued on next page.)

*Primary Examiner*—Tuan Nguyen
(74) *Attorney, Agent, or Firm*—Knobbe Martens Olson & Bear LLP.

(57) ABSTRACT

Disclosed is a cosmetic powder applicator. The powder applicator includes a powder container, an elastic structure connected to the container and a powder-permeable soft cover enclosing the elastic structure. The structure has an elasticity sufficient to substantially bend upon application of pressure thereto and to substantially recover an original shape thereof upon release of the pressure. The soft cover is so configured as to retain therein and pass powder particles through itself. The powder applicator is configured such that, by turning or shaking the applicator, the powder to be contained in the container can be discharged through the discharge opening toward the soft cover and the structure enclosed therein. Further disclosed is methods of making and using the powder applicator. The method of making includes a feature of connecting the elastic structure enclosed in the soft cover with the container such that the powder to be contained in the container can be discharged through the discharge opening toward the structure and the soft cover. The method of using the powder applicator includes a feature of contacting the soft cover with a skin, applying pressure onto the soft cover and the elastic structure thereunder such that the structure is substantially bent while maintaining structural rigidity thereof and releasing the pressure so as to allow the structure to recover an original shape thereof. The powder retained in the soft cover is transferred to the skin in the course of one or more of the contacting with the skin, and the application and release of the pressure.

55 Claims, 7 Drawing Sheets

U.S. PATENT DOCUMENTS

| | | | | |
|---|---|---|---|---|
| 6,244,773 | B1 * | 6/2001 | Geremia-Nargi | 401/202 |
| 6,299,377 | B1 | 10/2001 | Emerit et al. | |
| 6,595,969 | B1 * | 7/2003 | Emerit et al. | 401/266 |
| 2002/0021932 | A1 | 2/2002 | Gueret | |

FOREIGN PATENT DOCUMENTS

| | | |
|---|---|---|
| KR | 20-0165482 | 10/1999 |
| KR | 20-0190860 | 5/2000 |
| KR | 20-0209939 | 10/2000 |
| KR | 20-0236044 | 6/2001 |
| KR | 20-0246281 | 8/2001 |
| KR | 20-2002-0000430 | 1/2002 |
| WO | WO 99/22801 | 5/1999 |
| WO | WO 01/00056 | 1/2001 |

* cited by examiner

COSMETIC POWDER APPLICATOR AND METHOD FOR MAKING AND USING THE SAME

BACKGROUND OF THE INVENTION

1. Field of the Invention

The present invention relates to an article capable of storing and applying a powder chemical, and more particularly, to an article for containing cosmetic powder and instantly applying the powder to a skin.

2. Description of the Related Technology

In general, there are many cosmetics which are composed of powdered chemicals. A conventional toilet article for use in such powder cosmetics comprises a powder container for containing powders therein and a sponge or brush (cosmetic brush) used to powder a user's face. Since the sponge or brush is made separately from the powder container, a user can put it into the powder container. Then, the user can pick out and use the sponge or brush upon his/her makeup. Thus, if the user intends to put on his/her makeup using such a toilet article, the user must first apply the powder to the sponge or brush and then brings the sponge or brush into contact with his/her skin so that the powder can be put on the skin. Such a constitution has difficulty in storing the powder. Further, there is the inconvenience in that the user should perform two steps for applying powder to their skin.

In the meantime, Korean Utility Model Registration No. 20-246281 discloses a toilet article constructed such that a cosmetic brush is integrally coupled with a container for containing liquid foundation. The toilet article is constructed such that the liquid foundation is discharged to the brush when the user presses a button. The user can put on the liquid foundation on his/her face and the like for his/her makeup. However, such a toilet article has a complex constitution, and thus it is not suitable for using powdered cosmetics. Further, as the constitution of the toilet article becomes complex, its manufacturing process also becomes complex and thus its manufacturing costs are increased. Furthermore, in a case where a brush is used as an applying structure, the cosmetics adhering to the brush may be easily blown and scattered due to the elasticity of the brush.

SUMMARY OF THE INVENTION

One aspect of the present invention provides a powder applicator. The powder applicator comprises a powder container configured to contain powder and to have a discharge opening; an elastic structure connected to the container, wherein the structure has an elasticity sufficient to substantially bend upon application of pressure thereto and to substantially recover an original shape thereof upon release of the pressure, and wherein the structure has a proximal edge and a distal edge, the proximal edge being an edge of the structure including a point closest to the container, the distal edge being an edge of the structure including a point farthest from the container; a powder-permeable soft cover enclosing the elastic structure, wherein the soft cover is so configured as to selectively retain therein and selectively pass therethrough powder particles; and wherein the powder applicator is configured such that, by turning or shaking the applicator, the powder to be contained in the container can be discharged through the discharge opening toward the soft cover and the structure enclosed therein.

In various embodiments of the powder applicator, the container comprises at least one pliable wall for use to facilitate pressurizing the container for discharging powder. The container is further configured to have a supply opening for use to fill the container with powder, and wherein the hole is configured to be plugged.

In various embodiments of the powder applicator, the structure comprises a substantially flat surface. The structure is made of a flexible plastic. The structure is constructed such that the structure is more rigid toward the proximal edge than toward the distal edge. The structure comprises two opposing surfaces and further comprises one or more side surfaces which constitute a thickness between the two surfaces. The surfaces are substantially flat. The surfaces are substantially parallel with each other. The thickness of the structure is preferably from about 0.4 mm to about 3 mm, more preferably from about 0.5 mm to about 2 mm, most preferably from about 0.6 mm to about 1 mm. The thickness of the structure tapers in a direction from the proximal edge toward the distal edge. The thickness of the proximal edge is preferably from about 0.7 mm to about 3 mm, and wherein the thickness of the distal edge is preferably from about 0.4 mm to about 0.8 mm. The thickness of the proximal edge is more preferably from about 0.9 mm to about 2 mm. The thickness of the distal edge is more preferably from about 0.5 mm to about 0.7 mm. Each surface of the structure has a length in a direction from the proximal edge toward the distal edge, wherein each surface of the structure further has a width in a direction perpendicular to the direction from the proximal edge toward the distal edge, wherein the length is preferably from about 23 mm to about 42 mm, and wherein the width is preferably from about 20 mm to about 35 mm. The length is more preferably from about 30 mm to about 36 mm. The width is more from about 27 mm to about 30 mm. The structure has an elasticity coefficient below about 70 Mpa measured at 25° C. in accordance with ASTM D883.

In further embodiments of the powder applicator, the structure comprises a rib configured to provide structural rigidity of the elastic structure while maintaining the elasticity. The rib and structure are formed in a single piece. The rib is configured such that the structure is less rigid around the distal edge than around the proximal edge. The rib tapers in a direction from the proximal edge toward the distal edge. The rib extends substantially straight along a general direction in which the structure extends away from the container. The rib extends in proximity to a central line of the structure in a general direction in which the structure extends away from the container. The rib extends from a point about the proximal edge to a point between the proximal and distal edges. The structure has a length, and the rib extends to a point located between ¼ and ¾ of the length measured from the proximal edge. The point is located between about ⅖ and ⅗ of the length measured from the proximal edge.

In further embodiments of the powder applicator, the soft cover is configured to have a plurality of pores in which powder particles can be retained and through which powder can penetrate. The soft cover is made of sponge. The soft cover has a thickness preferably from about 0.6 mm to about 1.5 mm. The soft cover has a thickness, more preferably, from about 0.8 mm to about 1.2 mm. There is open space between the structure and the soft cover enclosing the structure. An interior surface of the soft cover is configured such that the structure has a substantially tight fit in the interior surface. The soft cover comprises fine fibers attached to an external surface thereof. There is substantially no open space between the structure and the soft cover enclosing the structure.

In further embodiments, the powder applicator further comprises a base contacting the proximal edge of the structure and configured to be directly or indirectly connected to the container. The base and the structure are formed in a single piece. The base comprises at least one through-hole configured to communicate with an interior of the container through the opening of the container. The powder applicator further comprises a plug closing the discharge opening and configured to be removed upon use. The powder applicator further comprises cosmetic powder contained in the powder container. The powder applicator further comprises a cap configured to sheath the soft cover. The cap comprises an outer structure and an inner structure, and wherein the inner structure is configured to define a space for the soft cover to be placed when the cap sheath the soft cover. There is an interior space between the inner and outer structures of the cap, and wherein the inner structure has at least one through-hole connecting the interior space and the space for the soft cover.

In still further embodiments, the powder applicator further comprises a fixing member configured to secure the elastic structure and the soft cover together. The fixing member comprises a side wall configured to wrap around a correspondingly shaped body integrated with the structure while keeping an edge of the soft cover between the side wall and the body. The fixing member is further configured to secure the elastic structure to the container. The powder applicator further comprises a coupler configured to couple both the fixing member and the container. The coupler comprises first and second coupling structures, wherein the first coupling surface is configured to removably couple with a corresponding structure of the fixing member, and wherein the second coupling surface is configured to removably couple with a corresponding structure of the container. The first and second coupling structures are one or more selected from the group consisting of threaded structure and knurled structure.

Another aspect of the present invention provides a method of making the powder applicator as described above. The method comprises: providing the powder container with the discharge opening; providing the elastic structure; providing the powder-permeable soft cover configured to selectively retain therein and selectively pass therethrough powder particles; enclosing the elastic structure with the soft cover; and connecting the elastic structure enclosed in the soft cover with the container such that the powder to be contained in the container can be discharged through the discharge opening toward the structure and the soft cover. The method further comprises filling the container with cosmetic powder prior to the connection.

Another aspect of the present invention provides another method of applying a cosmetic powder onto a skin surface. The method comprises: providing the powder applicator as described above, the container of which contains a cosmetic powder; turning or shaking the powder applicator so as to discharge the powder contained in the container through the discharge opening toward the structure and the soft cover, whereby some of the discharged powder is retained in the soft cover; contacting the soft cover to a skin surface; applying pressure onto the soft cover and the elastic structure thereunder such that the structure is substantially bent while maintaining structural rigidity thereof; releasing the pressure so as to allow the structure to recover an original shape thereof; and wherein the powder retained in the soft cover is transferred to the skin surface in the course of one or more of the contacts with the skin surface, and the application and release of the pressure.

Further aspect of the present invention provides an apparatus for use in applying a powdery material onto a surface. The apparatus comprises: means for containing and discharging powder; means for retaining the discharged powder; and means for elastically sandwiching the retaining means in cooperation with a surface onto which powder is to be applied, and thereby applying pressure on the retaining means so as to release at least part of the retained powder onto the surface.

Another aspect of the present invention provides a powder applicator in which an applicator unit for applying powder is integrally coupled with a powder container for containing the powder and which can also be used as a toilet article. Another aspect of the present invention provides a powder applicator wherein a sponge is employed in the applicator unit so that it is difficult for the powder to blown or scattered. A further aspect of the present invention provides a powder applicator capable of discharging the powder according to the proper amount of powder used.

One embodiment of the powder applicator comprises a powder container which includes an opening and contains powder therein, a powder applicator unit which is made of a sponge sheet having a plurality of fine pores and is formed into the shape of a pouch for covering the opening of the powder container, and a supporting member including a supporting portion which can be bent by external force and extends into the powder applicator unit to allow the shape of the powder applicator unit to be maintained. The supporting member may include a base portion coupled to the powder container not to move with respect thereto, and the supporting portion may take the shape of a plate extending from the base portion into the powder applicator unit. The base portion may be formed with at least one through-hole through which the powder container communicates with the interior of the powder applicator unit.

The powder applicator may further comprise a fixing member which includes a side wall for wrapping around the base portion of the supporting member so that an lower end of the applicator unit is fitted between and pressed by the base portion and the side wall. The powder applicator may further comprise a coupling member which supports the supporting member thereon, is positioned into the fixing member, and is coupled to an upper portion of the powder container. Preferably, any one of the coupling member and the powder container is formed with a male thread, whereas the other one is formed with a female thread. The powder container may further include a supply hole through which the powder is supplied into the powder container and a cap which is fitted into the supply hole. Preferably, the cap is formed with a male thread and the supply hole is formed with a female thread engaged with the male thread. The sponge sheet may be flocking processed. The powder applicator may further comprise a sheath or cap for covering the powder applicator unit, and the cap may also include an inner frame for covering the applicator unit and a cover member for wrapping around the inner frame. The inner frame may be provided with at least one through-hole which communicates with the interior of the cover member. The powder may be cosmetic powder.

BRIEF DESCRIPTION OF THE DRAWINGS

The above and other objects, features, and advantages of the present invention will become more apparent when reading the following description of preferred embodiments of the present invention given in conjunction with the accompanying drawings, in which.

DETAILED DESCRIPTION OF THE INVENTION

Hereinafter, preferred embodiments of the present invention will be explained in detail with reference to the accompanying drawings. In the embodiments to be described below, a toilet article will be explained as an example of a powder applicator.

Figure 1:
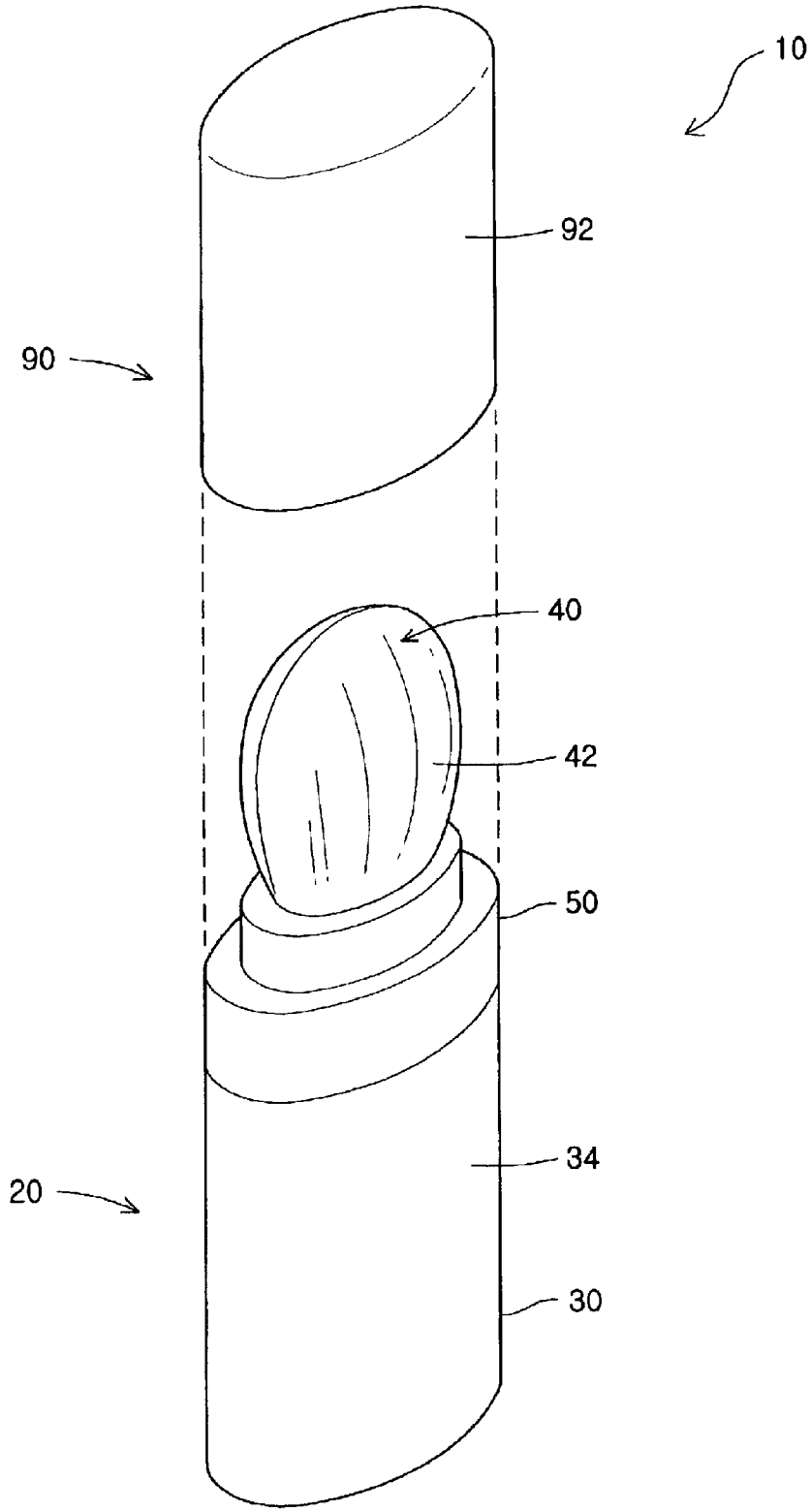
FIG. 1 is a perspective view of a toilet article according to a first embodiment of the present invention, showing a main body and a cover separated from each other.
Figure 2:
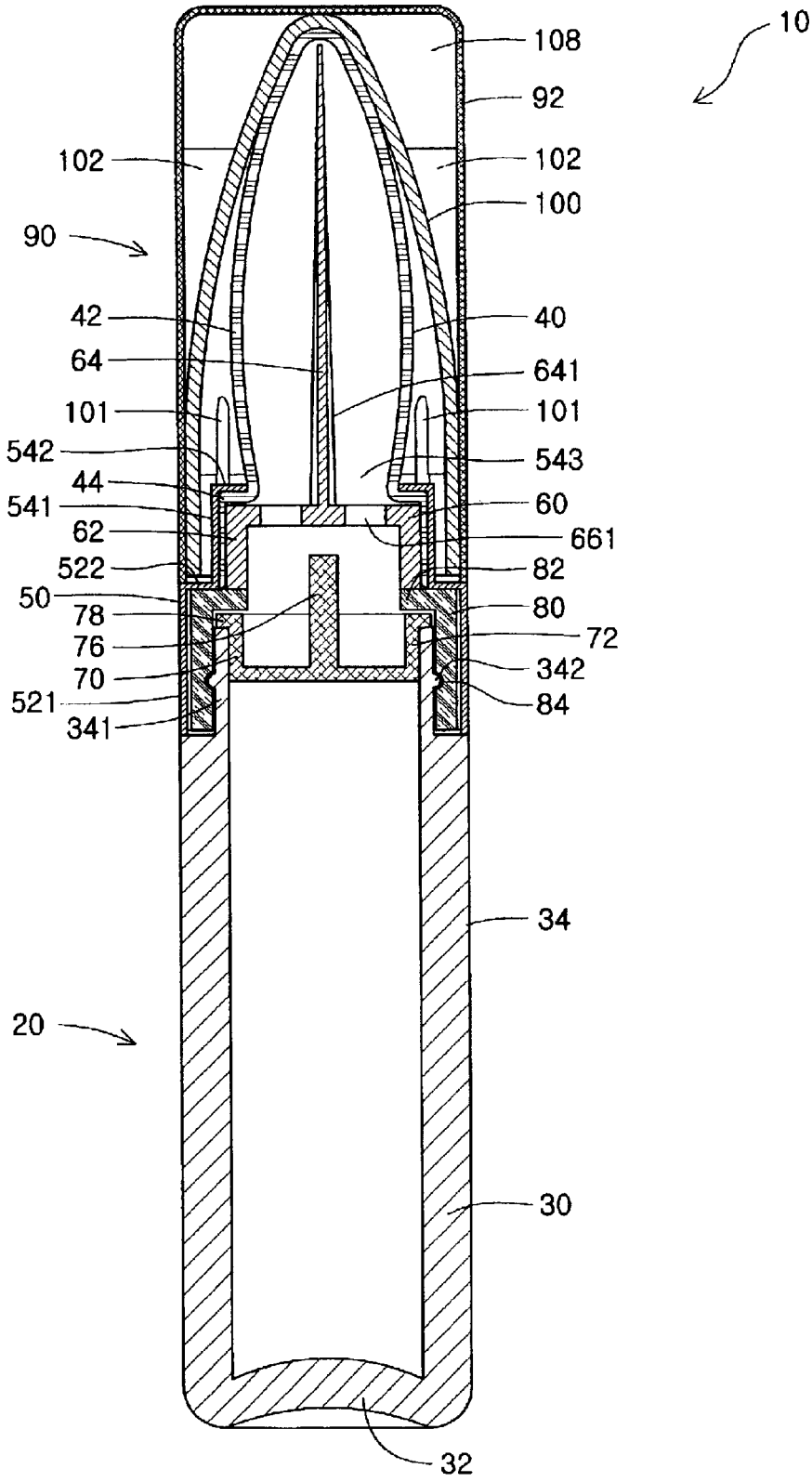
FIG. 2 is a sectional view of the toilet article of FIG. 1, showing the main body and the cover coupled with each other.

FIG. 1 is a perspective view of the toilet article according to a first embodiment of the present invention, and FIG. 2 is a longitudinal sectional view of the toilet article shown in FIG. 1. Referring to FIGS. 1 and 2, the toilet article 10 takes the shape of an elliptical cylinder, and comprises a main body 20 and a sheath or cap 90 for covering a part of the main body 20.

Figure 3:
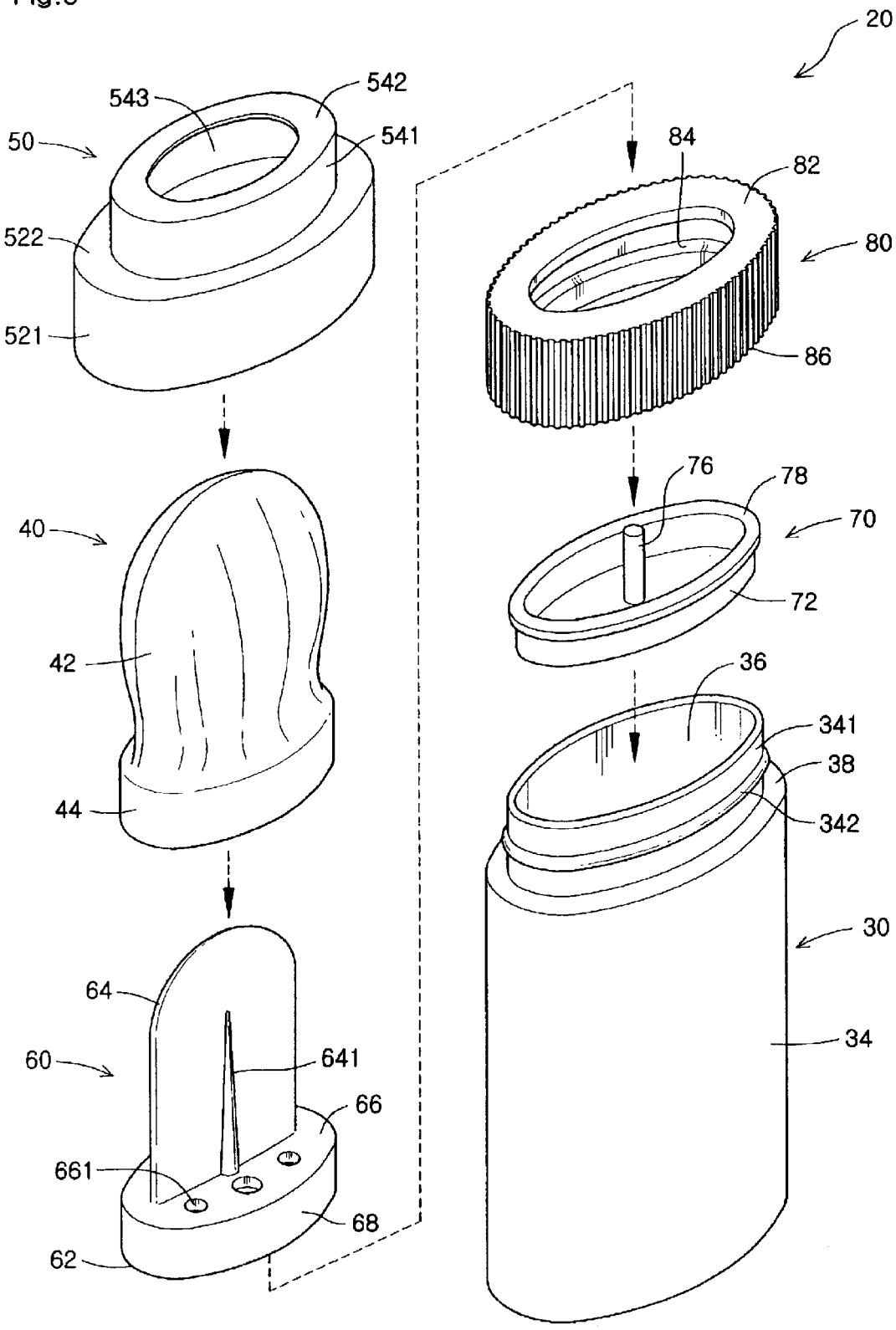
FIG. 3 is an exploded perspective view of the main body of the toilet article shown in FIG. 1.

Referring to FIGS. 1 to 3, the main body 20 includes a powder container 30, a powder applicator unit 40, a fixing member 50, a supporting member 60, a container coupling member 80, and a plug 70. The powder container 30 is a hollow elliptical cylinder of which one end is opened. The powder container 30 includes a bottom 32 and a side wall 34 extending upward from the bottom 32. An elliptical opening 36 is provided opposite to the bottom 32. The bottom 32 has an upwardly convex face. An end portion of the side wall 34 with the opening 36 formed thereon is provided with a coupling wall extending upward. As clearly shown in FIGS. 2 and 3, the coupling wall 341 is slightly stepped inward in such a manner that an outer surface thereof is located inward of an outer surface of the side wall 34. A step portion 38 is formed between the outer surface of the coupling wall 341 and the outer surface of the side wall 34. A coupling projection 342 domes out over the outer surface of the coupling wall 341 in the middle portion thereof. The coupling projection 342 extends in the form of a ring around the outer circumferential surface of the coupling wall 341. The powder container 30 can be made of a plastic resin through an injection molding process.

Referring to FIGS. 2 and 3, the plug 70 includes an elliptically formed body 72 which is inserted into the opening of the powder container 30, and a handle 76 extending to protrude from the center of the body 72. The body 72 is provided with a flange 78 at an upper edge thereof. The flange 78 is sized such that it cannot protrude beyond the outer surface of the coupling wall 341 when the plug 70 is plugged into the opening of the powder container 30 (refer to FIG. 2). Referring to FIG. 2, such a type of plug 70 is inserted and plugged into the opening 36 of the container 30. At this time, an outer circumferential surface of the body 72 of the plug 70 comes into contact with the inner circumferential surface of the powder container 30. Further, since the flange 78 of the plug 70 is caught in an upper end of the coupling wall 341 of the powder container 30, the plug 70 is prevented from being further pushed into the container 30. The plug 70 is also made of the plastic resin through the injection molding process. The plug 70 performs a function of preventing the powder from being discharged outside of the container 30 before initial use of the toilet article. When initially using the toilet article, the user grasps the handle 76 of the plug 70 and pulls out and removes the plug 70 from powder container. On the other hand, the toilet article may be sold without the plug 70.

Referring to FIGS. 2 and 3, the container coupling member 80 takes the shape of a short elliptical tube of which both ends are opened. An inner circumferential surface of the container coupling member is coupled with the coupling wall 341 of the powder container 30 to face the outer circumferential surface thereof. A top end of the container coupling member 80 is formed with a flange portion 82 which protrudes inward so that the area of a passage for the powder is reduced. The inner circumferential surface of the container coupling member 80 is formed with a coupling groove 84 into which the coupling projection 342 of the coupling wall 341 of the powder container 30 can be fitted. Further, the container coupling member 80 is provided at an outer circumferential surface thereof with a plurality of projections which extend straightly from the top end to a bottom end of the container coupling member 80 and formed close with one another around the outer circumferential surface. The projections 86 are such that it can be firmly coupled with the fixing member 50 to be described later.

Further, the supporting member 60 includes a base portion 62 and a thin plate-shaped supporting portion 64 extending upward from the base portion 62. The base 62 is composed of an elliptical flat portion 66 with a plurality of powder holes 661 formed thereon and a side wall 68 extending downward from the flat portion 66. A lower end of the side wall 68 is seated on the flange portion 82 of the container coupling member 80. It is preferred that an inner edge of the side wall 68 be coincident with an inner edge of the flange portion 82, as shown in FIG. 2. The flat portion 66 is provided with the plurality of round holes 661. Preferably, each of both section divided by the supporting portion 64 is provided with three powder holes. However, in the present invention, shapes and number of the powder holes 661 are not limited to the above. One large hole may be provided, and a plurality of small holes may also be provided.

The supporting portion 64 extends from the flat portion 66 and disposed along a major axis of the elliptical flat portion 66. The supporting portion 64 becomes thinner toward an upper end thereof, and the shape of the upper end is generally semicircular. A reinforcing rib 641 extending from the center of the flat portion 66 to a middle height of the supporting member 64 along the supporting member 64 is formed on each lateral side of the supporting member 64. Referring to FIG. 2, the base portion 62 is seated on the container coupling member 80 and secured into the fixing member 50 to be described later. The supporting portion 64 is accommodated within the powder applicator unit 40, and holds the powder applicator unit 40 so that the shape of the powder applicator unit 40 can be maintained. The supporting member 60 can be made of a soft plastic resin or flexible plastic material, which refers to any synthetic or natural material having the characteristics of pliability or flexibility, and resilience or elasticity. The flexible plastic material include, for example, polyethylene, polypropylene, nylon, etc. Preferably, the flexible plastic material has elasticity coefficient less than about 70 Mpa (7 $Kg/mm^2$) measured at 25° C. in accordance with ASTM D883.

The supporting member 60 is preferably made by a process of injection molding. The thin upper end of the supporting portion 64 made of the soft plastic resin can be bent laterally to a certain extent, and thus, the hard touch of the supporting portion can be reduced when the powder is put on the skin. Although the upper end of the supporting portion can be bent to a certain extent, the present invention is not limited thereto. In addition to the upper end, a lower end of the supporting portion may also be bent upon application of the cosmetics, depending on whether the reinforcing rib 641 is provided and to what extent thickness of the supporting portion 64 is set. Even in such a case, it is still necessary to have enough rigidity to maintain the shape of the applicator unit 40 when no external force is applied to the supporting portion.

Referring to FIGS. 2 and 3, the fixing member 50 includes a first elliptical side wall 521 and a first step portion 522 curved inward to extend perpendicular from an upper end of the first side wall 521. The first side wall 521 is sized such that it is tightly fitted around and coupled with the outer circumferential surface of the container coupling member 80. The fixing member 50 further includes a second side wall 541 curved upward to extend perpendicular from an inner end of the first step portion 522 and a second step portion 542 curved inward to extend perpendicular from an upper end of the second side wall 541. The second side wall 541 is sized such that the base portion 62 of the supporting member 60 can be accommodated therein.

Referring to FIG. 2, the container coupling member 80 is accommodated within the first side wall 521. The first side wall 521 comes into tight contact with the projections 86 of the container coupling member 80, and thus, the container coupling member 80 is fitted into and coupled with the fixing member 50. The base portion 62 of the supporting member 60 is accommodated within the second side wall 541. A lower end 44 of the powder applicator unit 40 to be described later is fitted between and pressed by the outer circumferential surface of base portion 62 and the second side wall 541. When supporting member 60 is fitted into the fixing member 50, the supporting portion 64 protrudes through an opening 543 formed inward of the second step portion 542. The opening 543 is sized such that the powder holes 661 can be exposed through the opening 543. An outer circumferential surface of the second side wall 541 comes into contact with a frame 100 of the cap 90 to be described later. The fixing member 50 can be made of metallic material such as aluminum through a drawing process. However, the present invention is not limited thereto.

Referring to FIGS. 1 and 2, the powder applicator unit 40 is made of a sponge sheet in the form of a pouch so that the powder can be contained therein. The powder applicator unit 40 includes an applicator part 42 capable of containing the powder and exposed to the outside of the fixing member 50. The lower end 44 of the applicator unit 40 is inserted into the fixing member 50, and is fitted and fixed between the fixing member 50 and the base portion 62. In other words, the lower end 44 of the applicator unit 40 is fitted between the second side wall 541 of the fixing member 50 and the base portion 62 of the supporting member 60, and the powder applicator unit 40 is consequently fixed. The supporting portion 64 of the supporting member 60 is housed in the applicator part 42 to allow the shape of the applicator part 42 to be maintained.

The powder applicator unit 40 can be constructed in such a manner that two sponge sheets are cut out and the overlapped sponge sheets are sewn with a bottom side thereof opened. A foam sponge material with fine pores formed therein is used as a sponge sheet. Since the fine pores are connected with one another, the sponge sheet has an open cell construction in which a plurality of holes passing through the sponge sheet can be formed. For example, a reticulated polyurethane foam sheet is used as the sponge sheet. Preferably, an external surface of the sponge sheet touched on the skin is subjected to so-called a flocking process so that the external surface is covered with fine fibers. For example, the fibers may be composed of nylon-based microfilaments.

A process of assembling the main body 20 is as follows. The supporting member 60 is first inserted into the pouch shaped applicator unit 40, and the supporting member 60 is caused to be coupled with the fixing member 50 while the applicator unit 40 passes through the upper opening 543 of the fixing member 50. At this time, the sponge sheet is fitted between and pressed by the second side wall 541 of the fixing member 50 and the base portion 62 of the supporting member 60. Then, the coupling member 80 is strongly pushed and press-fitted into the first side wall 521 of the fixing member 50. Thus, an upper part of the main body is completed. Thereafter, the upper part of the main body is coupled with the container 30 which is filled with the powder and then plugged with the plug 70. Finally, the main body of the toilet article is completed.

Figure 4:
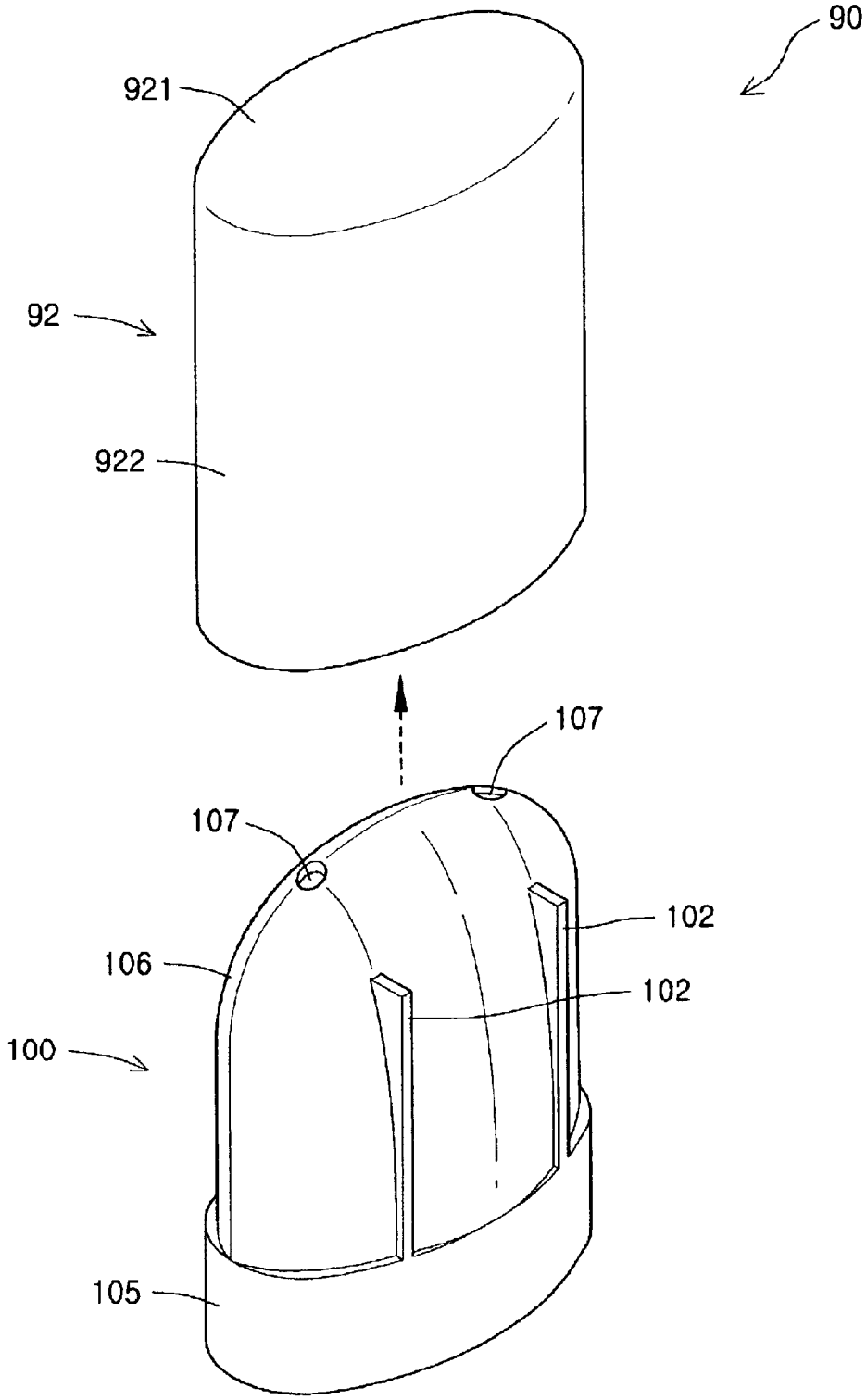
FIG. 4 is an exploded perspective view of the cover of the toilet article shown in FIG. 1.

Referring to FIGS. 1, 2 and 4, the cap 90 includes a outer member 92 and the frame 100 clamped into the outer member 92. The outer member 92 made of thin metal such as aluminum takes the shape of a hollow elliptical cylinder of which one end is opened. The outer member 92 includes a flat elliptical portion 921 and a side wall 922 extending downward from the flat portion 921. Preferably, the outer member 92 is sized such that an outer surface of the side wall 922 and the outer circumferential surface of the side wall 34 of the container 30 are coplanar when the cap 90 is put on. Although the outer member 92 is made of aluminum in the embodiment of the present invention, the present invention is not limited thereto.

Referring to FIGS. 2 and 4, the inner frame 100 includes a base portion 105 in the form of an elliptical ring, and a head portion 106 which extends upward from the base portion 105 and converges inward to have a round tip end thereof. The base portion 105 is configured such that an outer surface thereof comes into contact with an inner surface of the outer member 92. The inner frame 100 is fixed to the outer member 92 by firmly bringing the outer surface of the base portion 105 of the frame 100 into close contact with the inner surface of the outer member 92. If necessary, the two contact surfaces may be bonded together with adhesive. The head portion 106 is provided with outer ribs 102 extending vertically upward from the base portion 105. The outer ribs 102 come into contact with the inner surface of outer member 92 to prevent the frame 100 from rocking within the outer member 92. Circular through holes 107 are formed at the tip end of the head portion 106. Since air within the inner frame 100 and air within a space 108 between the inner frame 100 and the outer member 92 can communicate with each other, powder scattered due to pressure difference generated when the container 30 is opened or closed is minimized. Referring to FIG. 2, the frame 100 is configured to have an inner space corresponding roughly to a shape of the applicator unit 40. A plurality of inner ribs 101 are formed to extend from a bottom end of the base portion 105 to the middle of the head portion 106. When the cap 90 is fitted over the main body 20, the cap 90 and the main body 20 are engaged with each other by firmly bringing the inner ribs 101 into tight contact with the second side wall 541 of the fixing member 50. The frame 100 may be made of the plastic resin through the injection molding process.

Hereinafter, the operation of the toilet article will be explained in detail with reference to FIGS. 1 to 4. In use, the plug 70 is first removed from the powder container 30. If the container 30 is inverted, the cosmetic powder is moved into the powder applicator unit 40 through the holes 661 provided in the supporting member 60. At this time, a bit of the powder is discharged through the fine pores in the applicator unit 40 and adheres to an external surface of the applicator unit 40. Then, the user can bring the applicator unit 40 into contact with his/her skin and naturally apply the powder to the skin.

Figure 5:
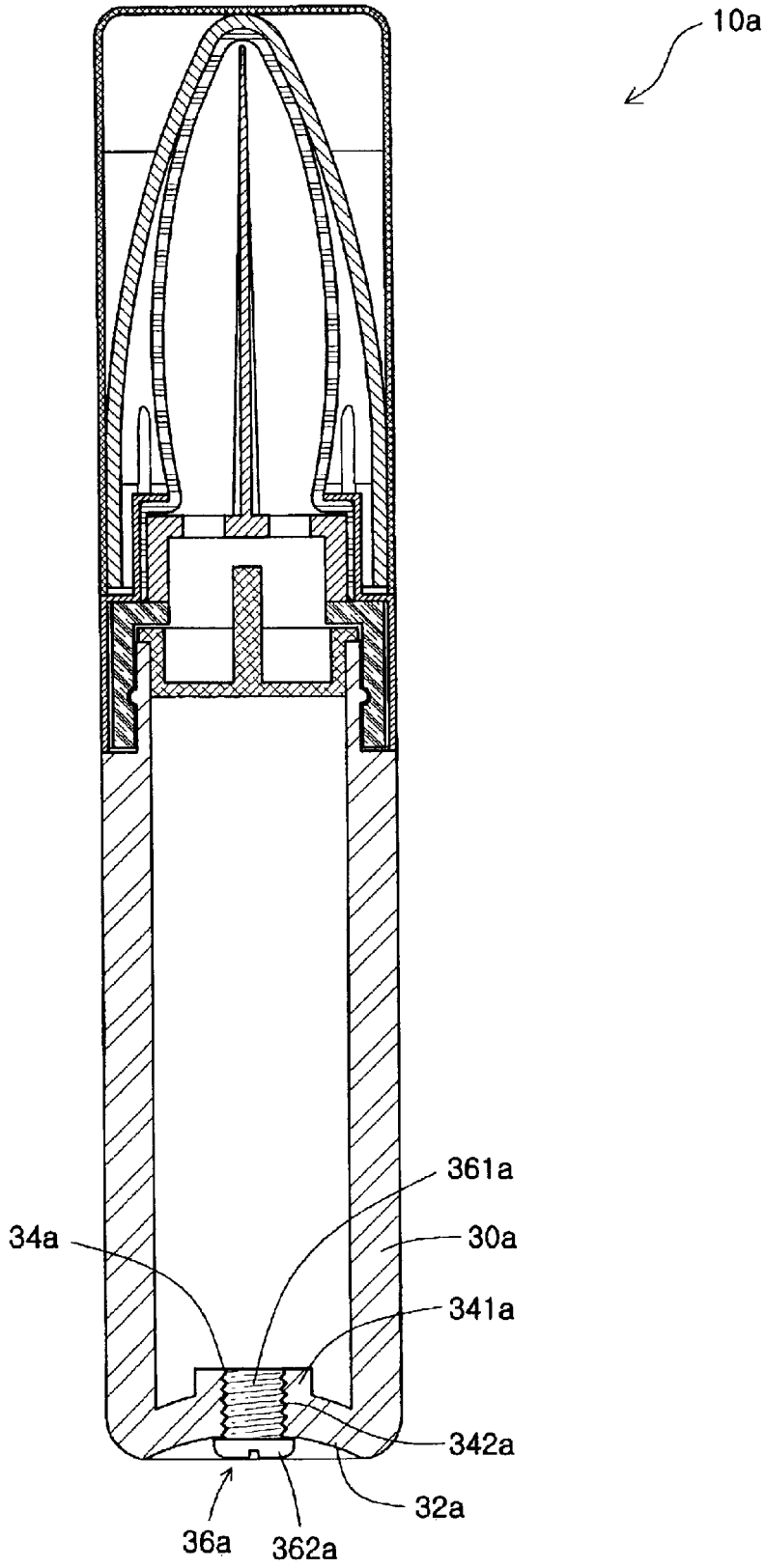
FIG. 5 is a sectional view of a toilet article according to a second embodiment of the present invention.

FIG. 5 is a sectional view of a toilet article according to a second embodiment of the present invention. Referring to FIG. 5, a powder container 30*a* is provided at a bottom 32*a* with a supply hole 34*a* for refilling the powder and with a hole plug 36*a* capable of plugging and unplugging the supply hole 34*a*. A side wall 341*a* containing the surface of the supply hole 34*a* slightly protrudes into the container 30*a*. A thread 342*a* is formed on the side wall 341*a*. The hole plug 36*a* includes a screw body 361*a* engaged with the thread 342*a* of the supply hole 34*a* and a screw head 362*a*. If the user intends to fill the powder container 30*a* with the powder, he/she turns the screw head 362*a* of the hole plug 36*a* and pulls out the hole plug 36*a* from the supply hole 34*a* to cause the supply hole 34*a* to be opened. Next, the user fills the container 30*a* with powder through the opened supply hole 34*a*, and then, plugs the supply hole 34*a* with the hole plug 36*a*. The other features and operations of the second embodiment of the present invention will not be further described herein since they are the same as in the first embodiment.

Figure 6:
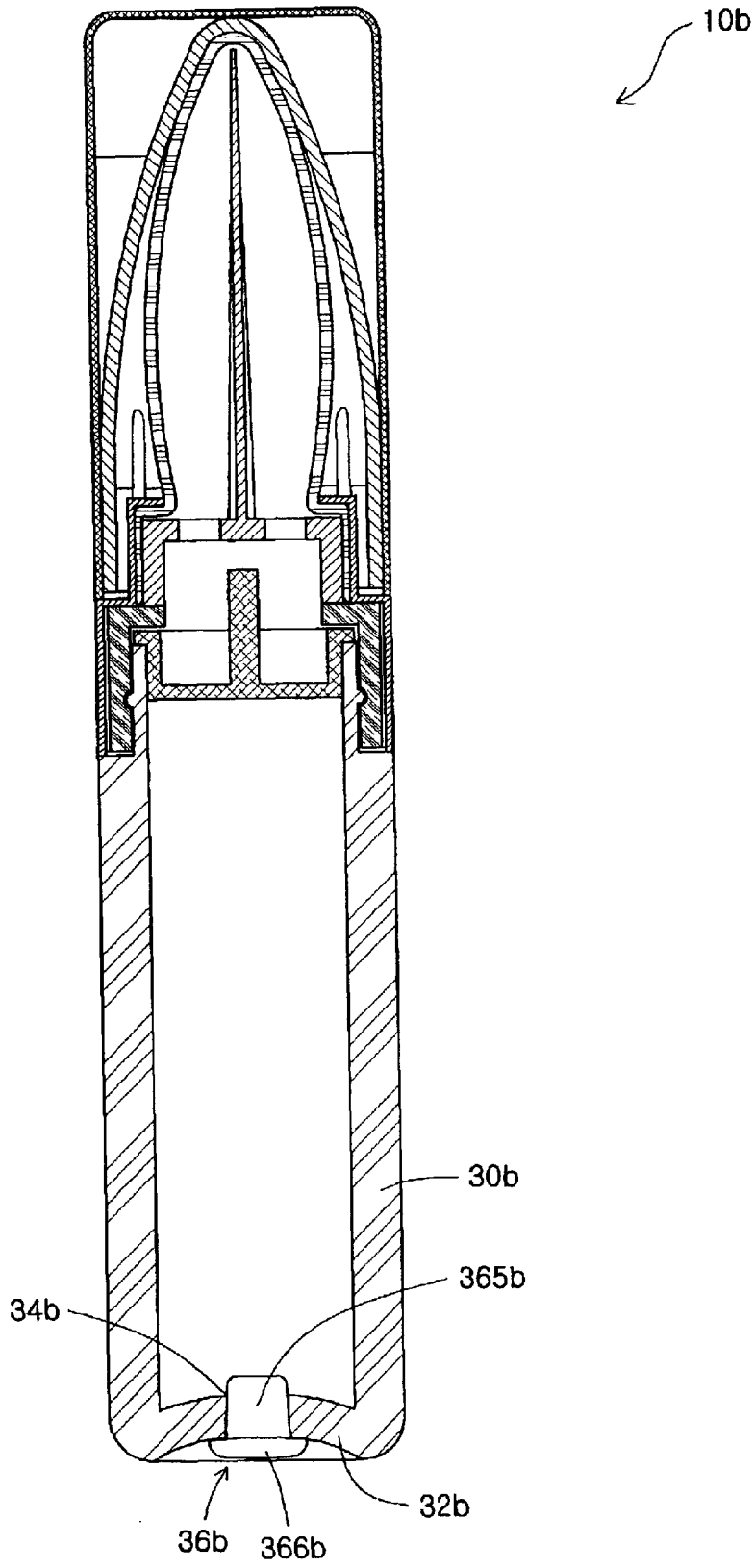
FIG. 6 is a sectional view of a toilet article according to a third embodiment of the present invention.

FIG. 6 is a sectional view of a toilet article according to a third embodiment of the present invention. Referring to FIG. 6, a powder container 30*b* is provided at a bottom 32*b* with a supply hole 34*b* for refilling the powder and with a hole plug 36*b* capable of plugging and unplugging the supply hole 34*b*. The hole plug 36*b* includes an insert 365*b* fitted into the supply hole 34*b* and a plug head 366*b*. The insert 365*b* comes into close contact with a wall surface of the supply hole 34*b*, and preferably, it has a little elasticity. If the user intends to unplug the supply hole 34*b*, he/she can pull the plug head 366*b* and pick the insert 365*b* out of the supply hole 34*b*. Further, if the user intends to plug the supply hole 34*b*, he/she can place the insert 365*b* at the entrance of the supply hole 34*b* and then push the plug head 366*b* and the insert 365*b* into the supply hole 34*b*. The other features and operations of the third embodiment of the present invention will not be further described herein since they are the same as in the first embodiment.

Figure 7:
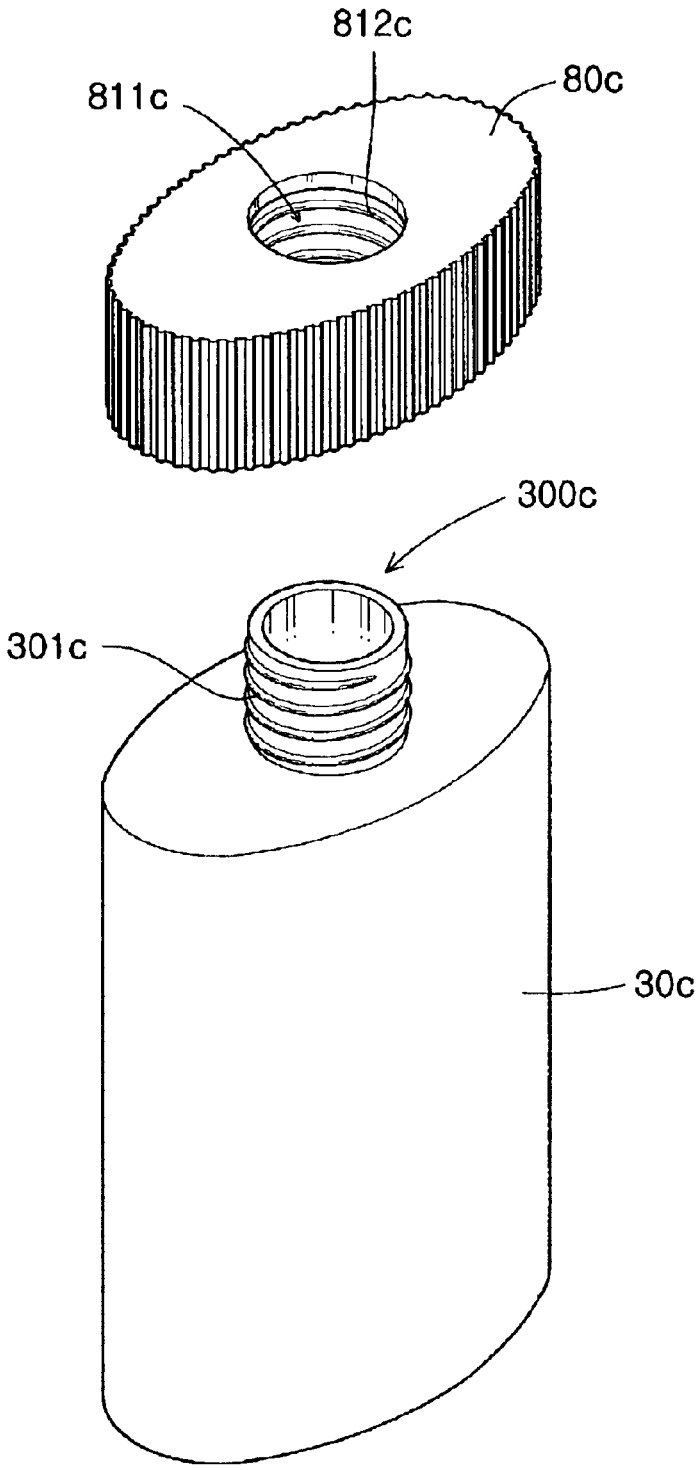
FIG. 7 is a perspective view of a powder container and a container coupling member of a toilet article according to a fourth embodiment of the present invention.

FIG. 7 is a perspective view of a powder container and a container coupling member of a toilet article according to a fourth embodiment of the present invention. Referring to FIG. 7, a powder container 30*c* in the form of an elliptical cylinder is provided at an upper surface with a cylindrical mouth 300*c*. The powder container 30*c* is open to the outside through the mouth 300*c*. A male thread 301*c* is formed on an outer circumferential surface of the mouth 300*c*. A container coupling member 80*c* in the form of an elliptical cylinder is provided with a circular coupling hole 811*c* which penetrates through a central portion thereof. A female thread 812*c*, which is engaged with the male thread 301*c* formed on the mouth 300*c* of the container 30*c*, is formed on a surface of the coupling hole 811*c* of the container coupling member 80*c*. The other features and operations of the fourth embodiment of the present invention will be not be further described herein since they are the same as in the first embodiment. The user can easily open and close the mouth 300*c* of the powder container 30*c* by turning the container coupling member 80*c*, and refill the powder into the container through the mouth 300*c*.

In the aforementioned embodiments of the present invention, it has been described that not only the cover and main body but also various kinds of members coupled therein with one another are elliptical in shape. However, the present invention is not limited thereto. If the respective members are able to perform their own functions in a proper fashion, any kind of shape such as a circle or polygon can be employed in the present invention. It will be understood by a person skilled in the art that the foregoing is included within the scope of the present invention.

Further, although the present invention has been described in connection with a toilet article in the preferred embodiments, it is not limited only to the toilet article. For example, it can be easily understood from the above detailed description of the invention that the present invention may be used as an applicator of powdered medicine. It will be also understood by a person skilled in the art that the use thereof is included within the scope of the present invention.

According to the present invention, since the powder and the cosmetic sponge are integrally provided in the applicator of the present invention, the powder container and additional brush or sponge used to apply the powder to the skin need not be prepared. Further, the applicator of the present invention is sanitary in that the powder is hardly blown and scattered when the makeup is performed (powder is put on the skin) or the cover is opened and closed. Furthermore, the applicator of the present invention can be easily manufactured and manufacturing costs thereof can be reduced, because the structure thereof is simplified.

Although the present invention has been described in connection with the preferred embodiments, it is not limited thereto. It will be understood by a person skilled in the art that modifications and changes can be made to the present invention without departing from the scope and spirit of the present invention, and that the present invention is intended to include these modifications and changes.

What is claimed is:

1. A powder applicator, comprising a powder container configured to contain powder and having an opening;

an elastic structure connected to the container, wherein the structure has an elasticity sufficient to substantially bend upon application of pressure thereto and to substantially recover an original shape thereof upon release of the pressure;

a powder-permeable soft cover enclosing the elastic structure, wherein the soft cover is so configured as to selectively retain therein and selectively pass therethrough powder particles a powder discharge structure connected to the container and configured to be separable from and reconnectable to the container, the powder discharge structure covering at least part of the opening of the container and being configured to discharge powder therethrough from the container toward the powder-permeable soft cover; and wherein the powder applicator is configured such that, by turning or shaking the applicator, the powder to be contained in the container can be discharged through the powder discharge structure toward the soft cover and the elastic structure enclosed therein.

2. The powder applicator of claim 1, wherein the container comprises at least one pliable wall for use to facilitate pressurizing the container for discharging powder.

3. The powder applicator of claim 1, wherein the container further comprises an additional opening for accessing an interior of the container, and wherein the opening is configured to be plugged.

4. The powder applicator of claim 1, wherein the elastic structure comprises a substantially flat surface.

5. The powder applicator of claim 1, wherein the elastic structure is made of a flexible plastic.

6. The powder applicator of claim 1, wherein the elastic structure has a proximal edge and a distal edge, the proximal edge being an edge of the elastic structure including a point closest to the container, the distal edge being an edge of the elastic structure including a point farthest from the container, and wherein the elastic structure is constructed such that the elastic structure is more rigid toward the proximal edge than toward the distal edge.

7. The powder applicator of claim 1, wherein the elastic structure comprise two opposing surfaces and further comprises one or more side surfaces which constitute a thickness between the two surfaces.

8. The powder applicator of claim 7, wherein the surfaces are substantially flat.

9. The powder applicator of claim 7, wherein the surfaces are substantially parallel with each other.

10. The powder applicator of claim 7, wherein the thickness of the elastic structure is from about 0.4 mm to about 3 mm.

11. The powder applicator of claim 7, wherein the thickness of the elastic structure is from about 0.5 mm to about 2 mm.

12. The powder applicator of claim 7, wherein the thickness of the elastic structure is from about 0.6 mm to about 1 mm.

13. The powder applicator of claim 7, wherein the elastic structure has a proximal edge and a distal edge, the proximal edge being an edge of the elastic structure including a point closest to the container, the distal edge being an edge of the elastic structure including a point farthest from the container, and wherein the thickness of the elastic structure tapers in a direction from the proximal edge toward the distal edge.

14. The powder applicator of claim 13, wherein the thickness of the proximal edge is from about 0.7 mm to about 3 mm, and wherein the thickness of the distal edge is from about 0.4 mm to about 0.8 mm.

15. The powder applicator of claim 14, wherein the thickness of the proximal edge is from about 0.9 mm to about 2 mm.

16. The powder applicator of claim 14, wherein the thickness of the distal edge is from about 0.5 mm to about 0.7 mm.

17. The powder applicator of claim 7, wherein the elastic structure has a proximal edge and a distal edge, the proximal edge being an edge of the elastic structure including a point closest to the container, the distal edge being an edge of the elastic structure including a point farthest from the container, wherein each surface of the elastic structure has a length in a direction from the proximal edge toward the distal edge, wherein each surface of the elastic structure further has a width in a direction perpendicular to the direction from the proximal edge toward the distal edge, wherein the length is from about 23 mm to about 42 mm, and wherein the width is from about 20 mm to about 35 mm.

18. The powder applicator of claim 17, wherein the length is from about 30 mm to about 36 mm.

19. The powder applicator of claim 17, wherein the width is from about 27 mm to about 30 mm.

20. The powder applicator of claim 1, wherein the elastic structure has an elasticity coefficient below about 70 Mpa measured at 25° C. in accordance with ASTM D883.

21. The powder applicator of claim 1, wherein the elastic structure comprises a rib configured to provide structural rigidity of the elastic structure while maintaining the elasticity.

22. The powder applicator of claim 21, wherein the rib and elastic structure are formed in a single piece.

23. The powder applicator of claim 21, wherein the elastic structure has a proximal edge and a distal edge, the proximal edge being an edge of the elastic structure including a point closest to the container, the distal edge being an edge of the elastic structure including a point farthest from the container, and wherein the rib is configured such that the elastic structure is less rigid around the distal edge than around the proximal edge.

24. The powder applicator of claim 21, wherein the elastic structure has a proximal edge and a distal edge, the proximal edge being an edge of the elastic structure including a point closest to the container, the distal edge being an edge of the elastic structure including a point farthest from the container, and wherein the rib tapers in a direction from the proximal edge toward the distal edge.

25. The powder applicator of claim 21, wherein the rib extends substantially straight along a general direction in which the elastic structure extends away from the container.

26. The powder applicator of claim 21, wherein the rib extends in proximity to a central line of the elastic structure in a general direction in which the elastic structure extends away from the container.

27. The powder applicator of claim 21, wherein the elastic structure has a proximal edge and a distal edge, the proximal edge being an edge of the elastic structure including a point closest to the container, the distal edge being an edge of the elastic structure including a point farthest from the container, and wherein the rib extends from a point about the proximal edge to a point between the proximal and distal edges.

28. The powder applicator of claim 27, wherein the elastic structure has a length, and the rib extends to a point located between ¼ and ¾ of the length measured from the proximal edge.

29. The powder applicator of claim 28, wherein the point is located between about ⅖ and ⅗ of the length measured from the proximal edge.

30. The powder applicator of claim 1, wherein the soft cover is configured to have a plurality of pores in which powder particles can be retained and through which powder can penetrate.

31. The powder applicator of claim 1, wherein the soft cover is made of sponge.

32. The powder applicator of claim 1, wherein the soft cover has a thickness from about 0.6 mm to about 1.5 mm.

33. The powder applicator of claim 1, wherein the soft cover has a thickness from about 0.8 mm to about 1.2 mm.

34. The powder applicator of claim 1, wherein there is open space between the elastic structure and the soft cover enclosing the elastic structure.

35. The powder applicator of claim 1, wherein an interior surface of the soft cover is configured such that the elastic structure has a substantially tight fit in the interior surface.

36. The powder applicator of claim 1, wherein the soft cover comprises fine fibers attached to an external surface thereof.

37. The powder applicator of claim 1, wherein there is substantially no open space between the elastic structure and the soft cover enclosing the elastic structure.

38. The powder applicator of claim 1, wherein the elastic structure has a proximal edge including a point closest to the container, and wherein the powder discharge structure contacts the proximal edge of the elastic structure.

39. The powder applicator of claim 38, wherein the powder discharge structure and the elastic structure are formed in a single piece.

40. The powder applicator of claim 38, wherein the powder discharge structure comprises at least one through-hole configured to communicate with an interior of the container through the opening of the container.

41. The powder applicator of claim 1, further comprising a plug closing the opening of the container and configured to be removed upon use.

42. The powder applicator of claim 1, further comprising cosmetic powder contained in the powder container.

43. The powder applicator of claim 1, further comprising a cap configured to sheath the soft cover.

44. The powder applicator of claim 43, wherein the cap comprises an outer structure and an inner structure, and wherein the inner structure is configured to define a space for the soft cover to be placed when the cap sheath the soft cover.

45. The powder applicator of claim 44, wherein there is an interior space between the inner and outer structures of the cap, and wherein the inner structure has at least one through-hole connecting the interior space and the space for the soft cover.

46. The powder applicator of claim 1, further comprising a fixing member configured to secure the elastic structure and the soft cover together.

47. The powder applicator of claim 46, wherein the fixing member comprises a side wall configured to wrap around a correspondingly shaped body integrated with the elastic structure while keeping an edge of the soft cover between the side wall and the body.

48. The powder applicator of claim 46, wherein the fixing member is further configured to secure the elastic structure to the container.

49. The powder applicator of claim 46, further comprising a coupler configured to couple both the fixing member and the container.

50. The powder applicator of claim 49, wherein the coupler comprises first and second coupling structures, wherein the first coupling structure is configured to removably couple with a corresponding structure of the fixing member, and wherein the second coupling structure is configured to removably couple with a corresponding structure of the container.

51. The powder applicator of claim 50, wherein the first and second coupling structures are one or more selected from the group consisting of threaded structure and knurled structure.

52. A method of making the powder applicator of claim 1, the method comprising:

providing the powder container with the opening;

providing the powder discharge structure;

providing the powder-permeable soft cover configured to selectively retain therein and selectively pass therethrough powder particles;

enclosing the elastic structure with the soft cover; and connecting the powder discharge structure with the container such that upon shaking or turning the applicator the powder can be discharged through the powder discharge structure toward the soft cover.

53. The method of claim 52, further comprising filling the container with cosmetic powder prior to the connecting the powder discharge structure with the powder container.

54. A method of applying a cosmetic powder onto a skin surface, comprising:

providing the powder applicator of claim 1, the container of which contains a cosmetic powder;

turning or shaking the powder applicator so as to discharge the powder contained in the container through the powder discharge structure toward the elastic structure and the soft cover, whereby some of the discharged powder is retained in the soft cover;

contacting the soft cover to a skin surface;

applying pressure onto the soft cover and the elastic structure thereunder such that the elastic structure is substantially bent while maintaining structural rigidity thereof;

releasing the pressure so as to allow the elastic structure to recover an original shape thereof; and wherein the powder retained in the soft cover is transferred to the skin surface in the course of one or more of the contacts with the skin surface, and the application and release of the pressure.

55. An apparatus for use in applying a powdery material onto a surface, comprising:

means for containing powder, the powder containing means having an opening;

means for discharging powder from the powder containing means and for covering at least part of the opening of the powder containing means, the powder discharging means being connected to the powder containing means and capable of being separated from and reconnected to the power containing means means for retaining powder discharged from the powder discharging means; and means for elastically sandwiching the retaining means in cooperation with a surface onto which powder is to be applied, thereby applying pressure on the retaining means so as to release at least part of the retained powder onto the surface.

* * * * *

UNITED STATES PATENT AND TRADEMARK OFFICE

CERTIFICATE OF CORRECTION

PATENT NO. : 6,805,510 B2
DATED : October 19, 2004
INVENTOR(S) : Young-Gu Lee

It is certified that error appears in the above-identified patent and that said Letters Patent is hereby corrected as shown below:

Column 10,
Line 44, after "comprising" insert -- : --.
Line 55, after "particles" insert -- ; --.

Column 14,
Line 47, after "means" insert -- ; --.

Signed and Sealed this

Sixth Day of June, 2006

JON W. DUDAS
*Director of the United States Patent and Trademark Office*